US012303008B2

(12) United States Patent
Milberg et al.

(10) Patent No.: US 12,303,008 B2
(45) Date of Patent: May 20, 2025

(54) DEVICE FOR NAIL PAINTING

(71) Applicants: Alessandro R. Milberg, San Isidro (PE); Marcia Valencia De Villena, San Isidro (PE)

(72) Inventors: Alessandro R. Milberg, San Isidro (PE); Marcia Valencia De Villena, San Isidro (PE)

( * ) Notice: Subject to any disclaimer, the term of this patent is extended or adjusted under 35 U.S.C. 154(b) by 320 days.

(21) Appl. No.: 17/488,265

(22) Filed: Sep. 28, 2021

(65) Prior Publication Data

US 2022/0095764 A1 Mar. 31, 2022

(51) Int. Cl.
*A45D 29/00* (2006.01)

(52) U.S. Cl.
CPC ..... *A45D 29/004* (2013.01)

(58) Field of Classification Search
CPC .... A45D 29/004; A45D 618/20; A45D 68/20; A45D 68/22; A61B 17/54
See application file for complete search history.

(56) References Cited

U.S. PATENT DOCUMENTS

| | | | | |
|---|---|---|---|---|
| 2,257,102 A * | 9/1941 | Breene | A45D 29/004 132/73 |
| 2,580,893 A * | 1/1952 | Dee | A45D 29/004 2/21 |
| 2,592,293 A * | 4/1952 | Knepper | A45D 29/004 132/285 |
| 5,143,100 A * | 9/1992 | Kawakami | A45D 29/004 132/73 |
| 5,577,521 A | 11/1996 | Neitlich | |
| 5,803,094 A | 9/1998 | Becker et al. | |
| 6,085,756 A | 7/2000 | Sexton et al. | |
| 2001/0006068 A1* | 7/2001 | Bolito | A45D 8/20 132/277 |

FOREIGN PATENT DOCUMENTS

| | | |
|---|---|---|
| CN | 102440512 A | 5/2012 |
| CN | 203106099 U | 8/2013 |
| DE | 102009059321 A1 | 6/2011 |

* cited by examiner

*Primary Examiner* — Rachel R Steitz
*Assistant Examiner* — Karim Asqiriba
(74) *Attorney, Agent, or Firm* — Rutan & Tucker LLP

(57) ABSTRACT

The present invention relates to a device for the painting of nails, during the work of nail painting it is sought that paint covers homogeneously the surface of the nails. Often when performing such work, the professional manicurist must be very careful that the paint brush does not stain the skin around the nail as the work must reflect an aesthetic quality. The nail manicuring device is characterized in that it comprises:

a first left outer piece (1); a second right outer piece (2); a third outer piece (3); a watch strap spring bolt (4); a pair of springs, wherein said pair of springs comprises a first spring (5) and a second spring (6), wherein the first left outer piece (1) is joined to the second right outer piece (2) and both are joined to the third outer piece (3) by means of the watch strap bolt (4), the springs (5) (6) attach to the third outer piece (3) allowing the pieces (1) (2) to function as a clamp which pulls the nail paronychium to perform the manicure work.

14 Claims, 4 Drawing Sheets

DEVICE FOR NAIL PAINTING

TECHNICAL FIELD

This invention refers to a device for nail painting, said device has been developed with the purpose of providing the user of said device with greater comfort when painting nails during manicure work.

BACKGROUND OF THE INVENTION

Nowadays both men and women have certain aesthetic habits to improve their appearance, one of them is to show healthy and hygienic hands, in that sense the manicure is an activity that has been developed in order to give the proper aesthetic appearance to the nails and hands. When painting the nails, the paint should be applied evenly over the nail surface. Often when performing such work, the professional manicurist must be very careful that the paint brush does not stain the skin around the nail as the work must reflect an aesthetic quality.

In the market there are different solutions to achieve a homogeneous painting of the nail, many times blocking solutions are used that are smeared around the nail which must be removed at the end of the painting work, in some cases devices are also used that are placed on the finger to facilitate the painting.

Currently, the coronavirus pandemic has hit several economic sectors, including the beauty sector, so many people have decided not to go to places where manicures are performed because they are afraid of getting infected. The device of this invention allows the user to paint his own nails without the need of another person or, in case it is done by a professional manicurist, to keep the regulatory social distance.

Within the state of the art, we can cite some patent documents that show technological solutions focused on solving the technical problem posed.

U.S. Pat. No. 6,085,756A "Method and Apparatus for Nail Painting"

A nail painting apparatus 10 is provided. The nail polishing apparatus includes a substantially "U"-shaped nail support part 12 and a substantially "V"-shaped integrally formed part 14. The part 12 includes a slot 18 into which a user can insert a finger 68. Surface 16 of part 12 effectively covers the skin and/or cuticles 78, 80 surrounding the nail 72, thereby avoiding unnecessary application of nail polish to these areas. Part 14 is adapted to pivotally support finger 68 and nail 72 at some distance above a surface 68.

U.S. Pat. No. 5,803,094A "Method and Aid for Artificial Nails Application"

Acrylic and fiberglass nails are applied using an aid that has a flexible nail support shield that wraps around the end of a human finger defining an opening suitable to receive a nail. A substantially tapered elastic pinch member defining an expandable indentation is positioned over the flexible support shield and the nail enhancement is applied over the shield.

U.S. Pat. No. 5,577,521A "Device for Polishing Nails"

This invention provides a device for polishing nails. The nail polishing device comprises an integral structure having a front part for the nail section and a rear part for a part of the finger backward from the nail. The front part extends around the side ends of the nail and the rear end of the nail. In another embodiment, the front part includes a section extending under and around the front of the nail being treated. The rear part extends around the top and side of the finger with a mechanism, such as a belt, in order to releasably secure the nail polishing device to the finger.

CN102440512A "Nail Polish Stencil"

One embodiment of a stencil for use in applying nail polish to a nail can include a tab. The tab may define an open-ended notch that is adapted to receive at least a part of the nail. The stencil may also include a retainer extending from the tab. The retainer is adapted to retain the tab on the nail.

DE102009059321A1 "Polishing Aid for Applying Nail Polish to the Fingernail or Toenail, it has an Extension Piece Forming an Extended Surface, where the Extension Piece Forms a Functional Edge for Pushing Under the Nail Plate"

The polishing ancillary (1) has an extension piece (2) forming an extended surface (3). The extension piece forms a functional edge (4) to push under the nail plate so that the extended surface adheres to the nail plate in the position of use. A support element is provided to hold the polishing auxiliary in the position of use during use. The support element supports the clamping force by pushing the functional edge under the nail plate.

CN203106099 Protective Tool for Nail Painting

The utility model describes a protective tool for painting nails comprising two arched plates. The two arched plates are connected via a spring and attached to the contour of the nail, the arched plates are provided with layers of elastic material, the arched plates are provided with a tiny magnifying glass and the tiny magnifying glass is movably connected to the arched plate. The protective nail painting tool has the advantages that the spring has elasticity, the two arched plates are held by a finger to paint when painting the nail, the arched plates can block the skin around the nail and prevent the nail polish from painting on the surrounding skin; the arched plates ensure a comfortable clamping sensation with the fingers because the layers of elastic material are arranged on the arched plates; and because the tiny magnifying glass is arranged on the arched plates, the position to be painted on the nail can be enlarged, fine operation can be convenient and the nail polish is further prevented from painting the surrounding skin of the nail.

The protective nail painting tool can protect the skin outside the nail and help people paint the nail finely, improve efficiency and save time.

The disadvantage of the inventions of the patents mentioned above is that most of them work by invading the space between the skin of the paronychium and the nail. Many times, despite the placement of the mentioned devices, the paint still invades the paronychium, so in the end you end up using blocking solutions that gelatinize around the paronychium and are removed after the manicure, making this work more complicated.

EXPLANATION OF THE INVENTION

This invention is defined as a nail manicuring device which comprises three outer pieces and three inner pieces.

Two of the outer pieces work together, both are designed to fit inside each other and are joined by a central axis forming at one end a sharp-edged clamp whose main purpose is to remove the strip of skin fold on the sides of the nail (lateral nail stripes or Paronychium) sideways. The ends of the clamp have a diagonal ending that allows to follow the proper shape of the finger to pull the skin of the paronychium avoiding excess pressure on the closest part to the phalanx, as well as allowing any finger diameter to use the invention.

These same two pieces on the outer part have a concave surface so that the fingers of the other hand holding the invention (index finger and thumb) can hold well and exert the necessary pressure comfortably.

The third outer piece is a rounded piece that functions as the base of the invention so that it can rotate and remain stationary, as well as to hide the internal operating system of the invention.

On the internal part the invention has two springs that are installed in such a way that the main outer pieces can return to their original place by rotating around the central axis. The third inner part is a watch strap spring bolt that runs through the invention from end to end through the three outer parts functioning as the central axis.

The invention helps nail painting, this help is offered mainly because it facilitates the passage of the nail polish brush along all the edges of the nail closest to the skin fold strip on the sides of the nail without painting the skin, it also provides a support base, a correct height and rotating capacity to the finger being painted. The result, a personal nail painting as if it were professional, easy and effective.

The invention facilitates the passage of the brush along the edges of the nail because it works as a clamp that engages with pressure on the last phalanx of the finger, just where the fingertip meets the nail, withdrawing sideways the strip of skin fold on the sides of the nail, called paronychium, causing the skin to move away and separate from the nail, leaving space for the brush to pass easily, achieving a correct painting without painting the skin of the finger.

The invention holds the finger being painted at a height of 4 cm, allowing the finger to maintain a resting position and an angle of approximately 25 degrees, which facilitates painting using the opposite hand.

The invention also provides a support base for the finger, this is mostly rounded so that the finger can rotate to all angles, facilitating the work of painting with the opposite hand. The rounded base only has a central 8 mm flat part that allows the invention to stand upright if desired.

BRIEF DESCRIPTION OF THE DRAWINGS

To complement the description that is being made and in order to help a better understanding of the characteristics of the invention, a set of drawings is attached as an integral part of this description, in which the following has been illustrated in an illustrative and non-limiting manner.

DETAILED DESCRIPTION OF THE INVENTION

Figure 1:
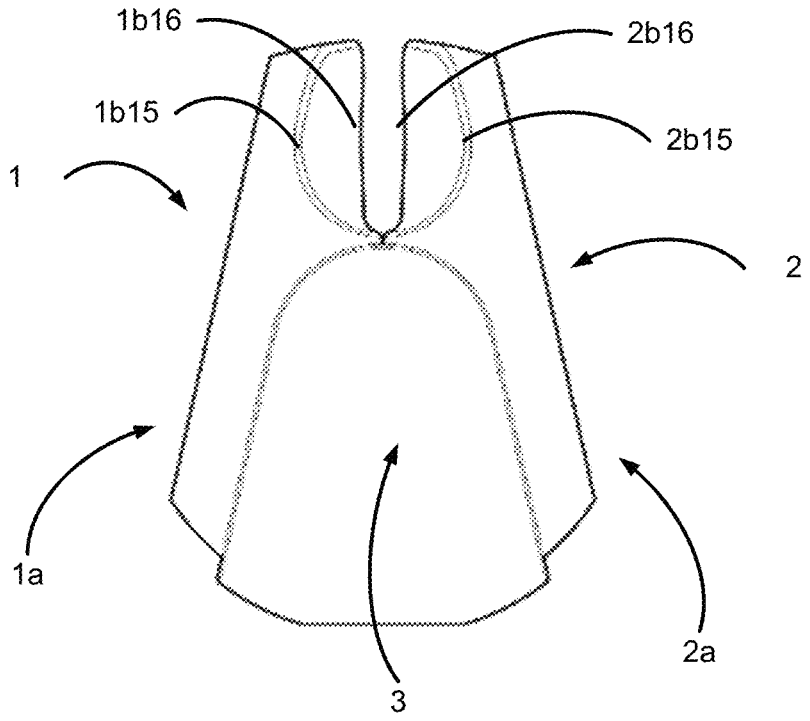
FIG. 1: Rear view of the nail manicure device.

A first aspect of this invention relates to a nail manicure device characterized in that it comprises:

Two of the outer pieces work together, both are designed to fit inside each other and are joined by a central axis forming at one end a sharp-edged clamp whose main purpose is to remove the strip of skin fold on the sides of the nail (lateral nail stripes or Paronychium) sideways. The clamp part forms a diagonal opening that allows to follow the proper shape to pull the skin of the finger avoiding excess pressure on the part closest to the phalanx, as well as allowing any finger diameter to use the invention.

These same two pieces on the outer part outline a concave surface so that the fingers of the other hand holding the invention (index finger and thumb) can hold well and exert the necessary pressure comfortably.

The third outer piece is a rounded piece that functions as the base of the invention so that it can rotate and remain stationary, as well as to hide the internal operating system of the invention.

On the internal part the invention has two springs that are installed so that the main outer pieces can be returned to their original place. The third inner part is a watch strap spring bolt that runs through the invention from end to end through the three outer parts.

A second aspect of this invention relates to the use of a nail manicure device.

A third aspect of this invention relates to a nail manicure procedure characterized in that it comprises:

a) Having a nail manicure device as described in the first aspect.

b) Opening the manicure device with the index finger and thumb of one hand to press one finger of the other hand against the outer faces of the pieces forming the clamp of the manicure device.

c) Placing the finger in the cavity formed between the inner faces of the pieces that form the clamp in such a way that when the clamp is closed the paronychium of the fingers is pushed downwards.

d) Using a soft brush or paintbrush, apply the nail polish on the nail that is more exposed due to the pressure exerted by the clamp.

PREFERRED EMBODIMENT OF THE INVENTION

This invention will be best understood by referring to the following non-limiting examples:

Example 1

A nail manicure device characterized in that it comprises:

a first outer left piece (1);

a second outer right piece (2);

a third outer piece (3);

one watch strap spring bolt (4)

A pair of springs, wherein said pair of springs comprises a first spring (5) and a second spring (6); wherein, the first left outer piece (1) has an outer face (1 *a*) and an inner face (1 *b*), the outer face (1 *a*) has two sections (1 *a* 1, 1 *a* 2) and the inner face (1 *b*) has three sections, the surface of said two sections (1 *a* 1, 1 *a* 2) defines a curved contour ergonomically compatible with the shape of the finger of the index hand or thumb; said three sections comprise the upper section (1 *b* 1), the middle section (1 *b* 2) and the lower section (1 *b* 3) of said inner face (1 *b*), the upper section (1 *b* 1) of the inner face (1 *b*) has a surface whose thickness draws a semi-parabola with a larger straight side (1 *b* 16) at a left end and a very small straight side at the right end. The middle section (1 *b* 2) and the lower section (1 *b* 3) are thicker than the upper section (1 *b* 1) of the inner face (1 *b*).

The middle section (1*b*2) viewed laterally has a minor extension (1*b*21) followed by a major concavity (1*b*22) and a major extension (1*b*23) followed by a minor concavity (1*b*24), from left to right; the minor extension (1*b*21) has a central hole, the major extension (1*b*23) has a central hole, both holes are concentric and isodiametric.

The lower section (1*b*3) has the shape of a semicircle with 3 concavities, a central circular concavity (1*b*30) and 2 lateral concavities (1*b*31, 1*b*32).

The first right outer piece (2) has an outer face (2 *a*) and an inner face (2 *b*), the outer face (2 *a*) has two sections (2 *a* 1, 2 *a* 2) and the inner face (2 *b*) has three sections, the surface of said two sections (2 *a* 1, 2 *a* 2) defines a curved contour ergonomically compatible with the shape of the index finger or thumb, said 3 sections comprising the upper section (2 *b* 1), the middle section (2 *b* 2) and the lower section (2 *b* 3) of said inner face (2 *b*); the upper section (2 *b* 1) of the inner face (2 *b*) has a surface whose thickness draws a semi-parabola with a larger straight side (1 *b* 16) at a left end and a very small straight side at the left end. The middle section (2 *b* 2) and the lower section (2 *b* 3) are thicker than the upper section (2 *b* 1) of the inner face (2 *b*).

The middle section (2*b*2) viewed laterally has a minor cavity (2*b*21) followed by a major extension (2*b*22) and a major concavity (2*b*23) followed by a minor extension (2*b*24), from right to left; the lower section (2*b*3) is semi-circular in shape with 3 concavities, a central circular concavity (2*b*30) and 2 lateral concavities (2*b*31, 2*b*32); the minor extension (2*b*21) has a central hole, the major extension (2*b*23) has a central hole, both holes are concentric and isodiametric.

When the first left outer piece (1) and the first right outer piece (2) are joined it can be seen that they define a cavity with an opening (1 *b* 15, 2 *b* 15) similar to the shape of a parabola with a major straight side (1 *b* 16, 2 *b* 16), on one side and an opening similar to the shape of a parabola with a minor straight side (1 *b* 15, 2 *b* 15) on the other side, the finger enters through the opening in the shape of a parabola with the major straight side. The rear view of the device (FIG. 1) shows these openings.

Figure 2:
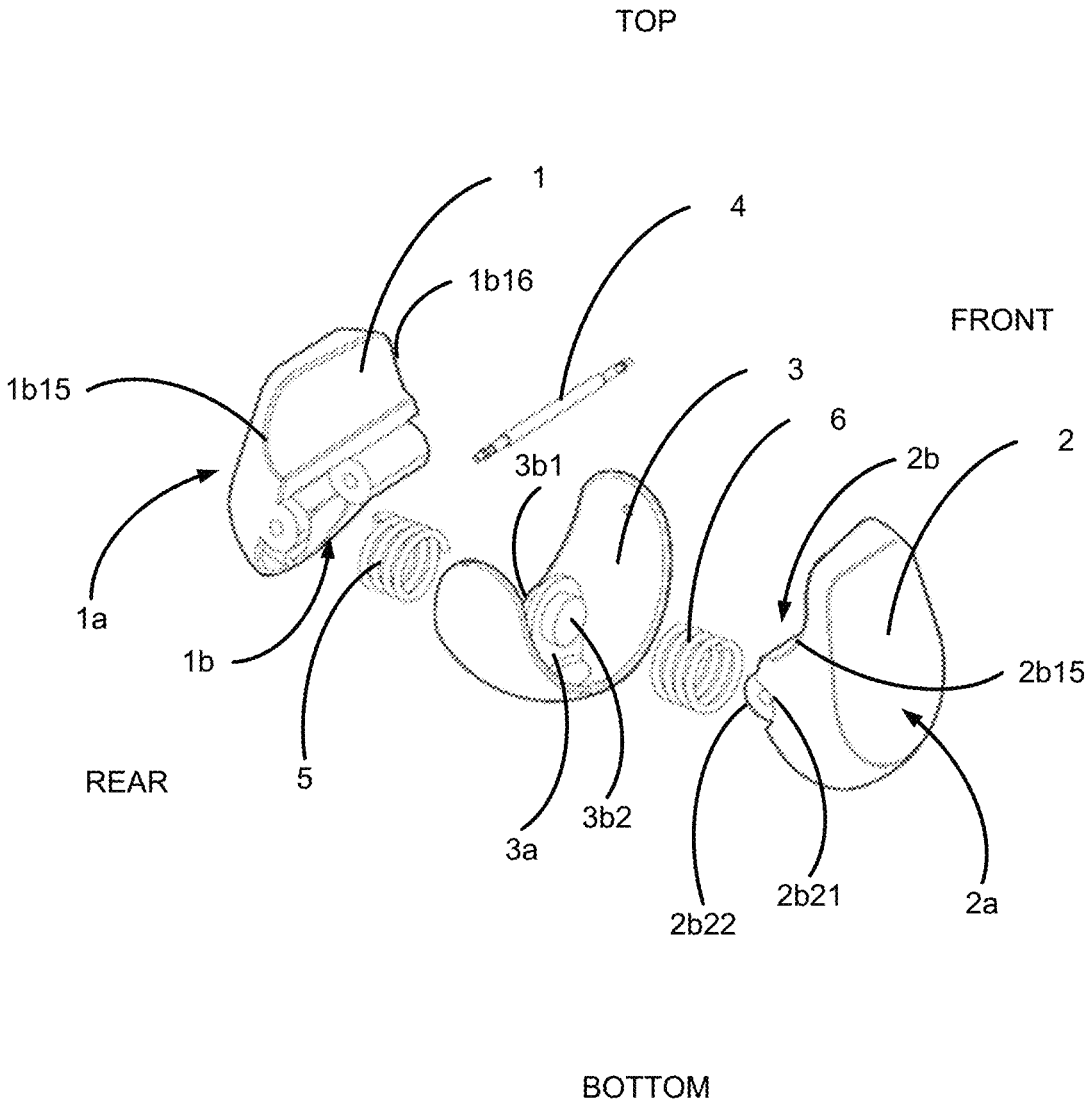
FIG. 2: Exploded view of the nail manicure device.
Figure 3:
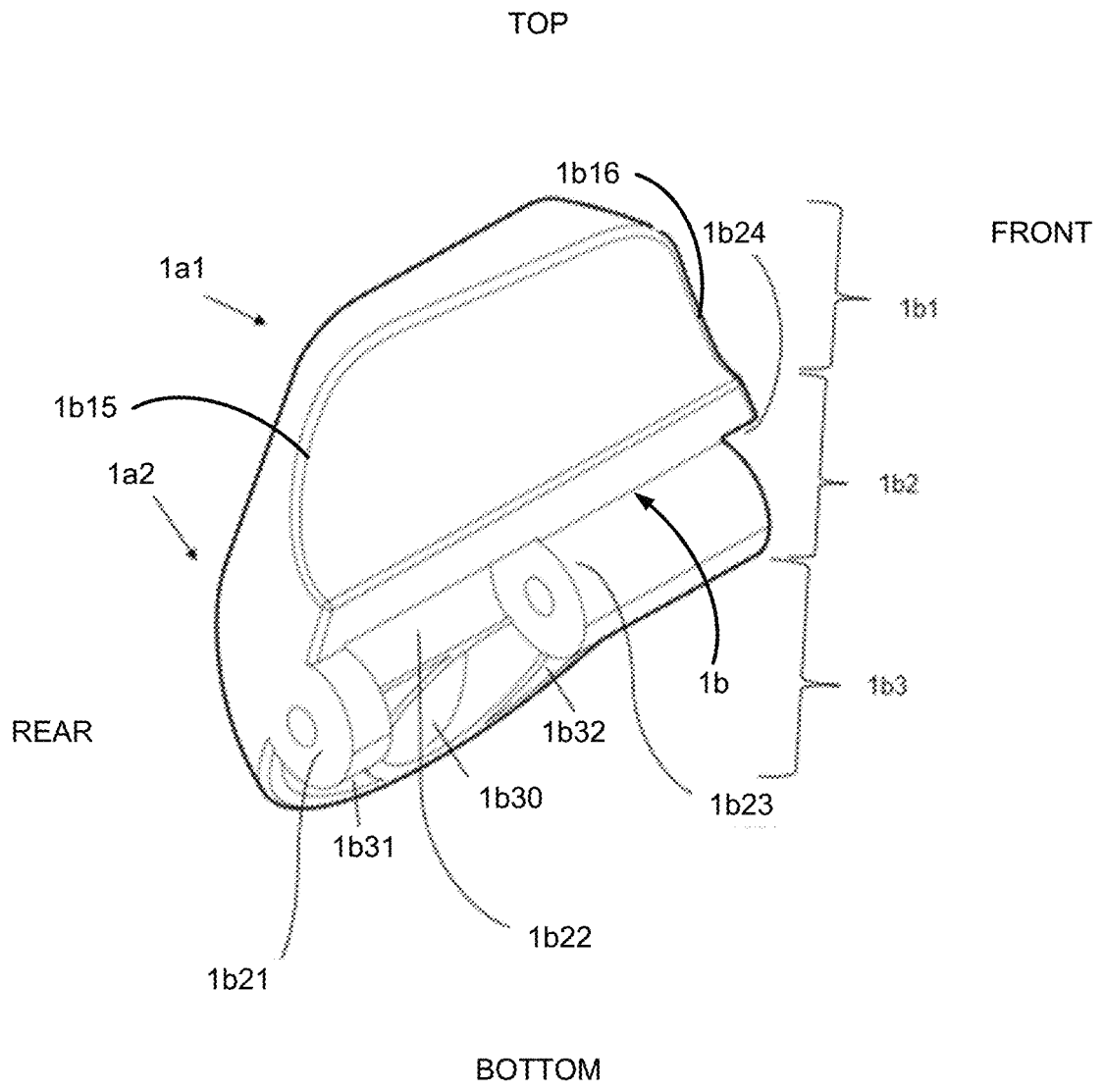
FIG. 3: Isometric view of the first left outer piece, the left side of the surface of 1*b*1 has a greater concavity than the right side.
Figure 4:
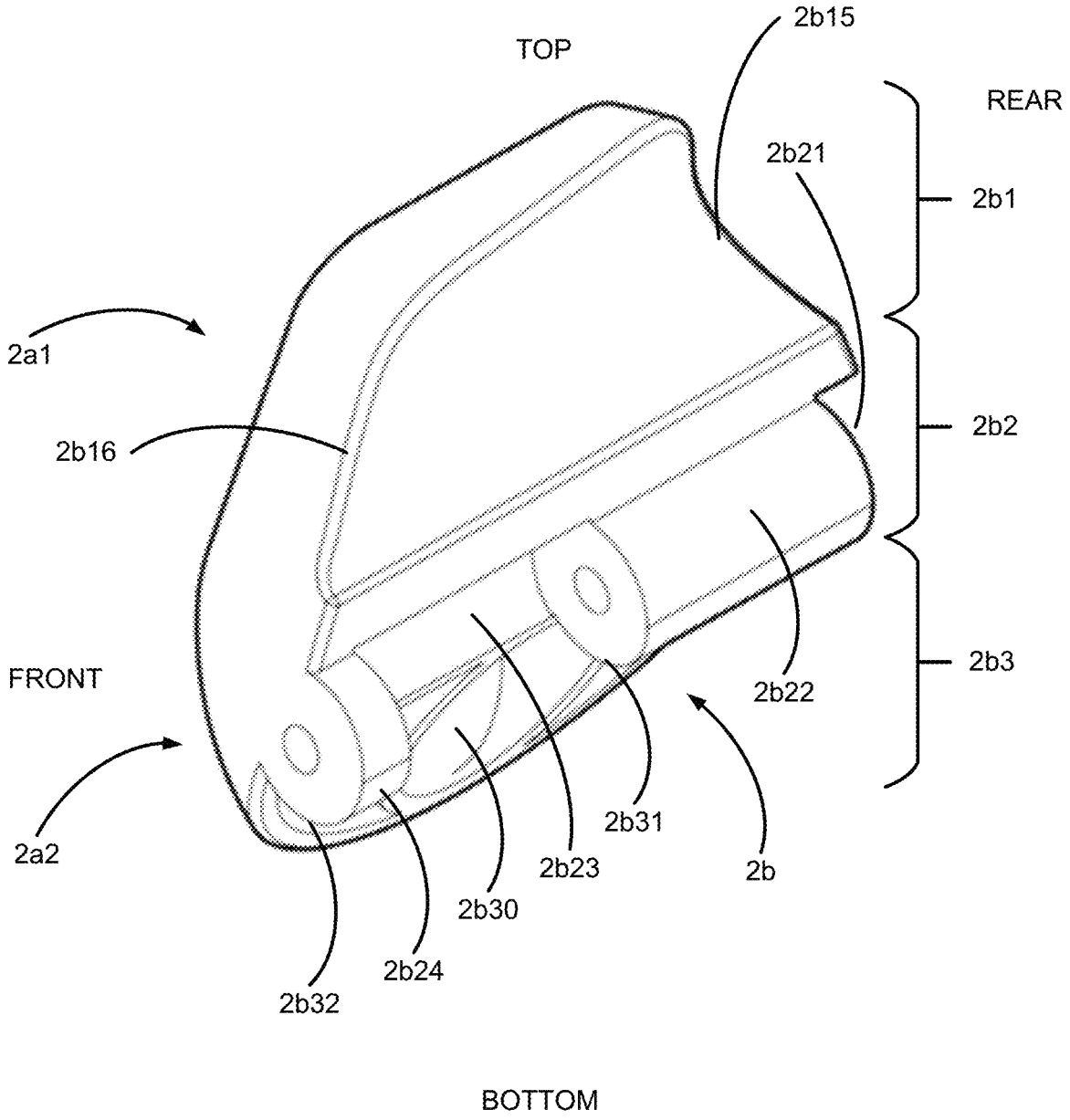
FIG. 4: Isometric view of the second right outer piece, the left side of the surface of 2*b*1 has a smaller concavity than the right side.

The third outer piece (3) has the shape of a spherical spindle, the ends of which are blunt and in one of them there is a hole, in the center of the base of the third outer piece has an extension 3*a* from which two flattened cylinders (3*b*1, 3*b*2) project towards both faces of said extension, the flattened cylinders serve as anchorage for one end of the first spring (5) and one end of the second spring (6), the other end of the first spring fits into the central circular concavity (1*b*30) and the other end of the second spring (6) fits into the central circular concavity (2*b*30). In FIG. 2, the flattened cylinder 3*b*1 is hidden by the position of the exploded view.

The first left outer piece (1) and the first right outer piece (2) work together in such a way as to engage their extensions and concavities of the respective middle section (1*b*2) and middle section (2*b*2) of both outer pieces, said first left outer piece (1) and first right outer piece (2) are designed so that they can fit one inside the other and are joined by the watch strap spring pin (4) forming at one end a sharp-edged clamp, the clamp part forms a diagonal opening that allows to follow the proper shape to pull the skin of the finger avoiding excess pressure on the part closest to the phalanx, as well as allowing any finger diameter to use the invention.

This first left outer piece (1) and the first right outer piece (2) on the outer part outline a concave surface so that the fingers of the other hand holding the invention (index finger and thumb) can hold well and exert the necessary pressure comfortably.

The third outer piece (3) is a rounded piece that functions as the base of the invention so that it can rotate and remain stationary, as well as to hide the internal operating system of the device.

In the inner part the invention has two springs (5), (6) that are installed in such a way that the main outer pieces (1), (2) can return to their original place.

The third inner part is a watch strap spring bolt (4) which crosses the invention from end to end through the pieces: first left outer piece (1), first right outer piece (2) and third outer piece (3).

The watch strap spring bolt passes through the first left outer piece (1), first right outer piece (2) and third outer piece (3) in such a way that the concavities and the middle section extensions (1*b*2) of the left outer piece (1) fit into the concavities and the middle section extensions (2*b*2) of the right outer piece (2), when the two pieces (1) and (2) are assembled they function as a clamp, the inner faces having a diagonal shape such that a finger cavity is formed, said finger cavity being formed from the upper section (2*b*1) of the inner face (2*b*) of the right outer piece (2) and the upper section (1*b*1) of the inner face (1*b*) of the left outer piece (1), the finger can be inserted into the said finger cavity and is adjusted with the clamp according to the size of the finger, the finger rests on the base of the 2 semi parabolic surfaces and is at an angle of 25°, thus facilitating the manicure work.

The invention claimed is:

1. A manicure device comprising:

a left outer piece having an outer face and an inner face, the outer face having a first section and a second section co-operating to define a curved contour ergonomically compatible with a first finger or thumb of a first hand, the inner face having a left upper section, a left middle section, and a left lower section;

a right outer piece having an outer face and an inner face, the outer face having a first section and a second section co-operating to define a curved contour ergonomically compatible with a second finger or thumb of the first hand, the inner face having a right upper section, a right middle section, and a right lower section;

wherein the left middle section and the right middle section extend from front to back along a hinge axis, and wherein a straight front edge of the left upper section and a straight front edge of the right upper section extend at an angle to the hinge axis to support a nail of a finger or thumb of a second hand at an angle relative to the hinge axis;

a base piece having a spherical lune shaped outer surface extending between a first blunt end and a second blunt end, a center of an inner surface of the base piece includes an extension from which two flattened cylinders project, a first flattened cylinder in a first direction and a second flattened cylinder in a second direction, opposite the first direction;

wherein the base piece includes a flat portion extending over two axes extending perpendicular to each other and disposed equidistant between the first blunt end and the second blunt end and configured to engage a surface and support the hinge axis of the manicure device substantially parallel to the surface;

a watch strap spring bolt configured to hingedly engage the left outer piece with the right outer piece and allow the left outer piece and the right outer piece to transition between an open position and a closed position; and a pair of springs comprising a first spring and a second spring and configured to bias the left outer piece and the right outer piece to the closed position.

2. The manicure device according to claim 1, wherein the inner face of the left outer piece further comprises:

the upper section defining a concave surface having a concave rear edge defining a semi-parabola;

the middle section including a left minor extension disposed rearwards, followed by a left major concavity, followed by a left major extension, followed by a left minor concavity disposed frontwards, the left minor extension has a central hole and is axially aligned with a central hole of the left major extension, wherein the central holes are concentric and isodiametric; and the lower section has a semicircular lower perimeter, a central circular concavity, and two lateral concavities.

3. The manicure device according to claim 2, wherein the inner face of the right outer piece further comprises:

the upper section defining a concave surface having a concave rear edge defining a semi-parabola;

the middle section including a right minor concavity disposed rearwards followed by a right major extension, followed by a right major concavity, followed by a right minor extension disposed frontwards, the right minor extension includes a central hole axially aligned with a central hole of the right major extension, wherein the central holes are concentric and isodiametric; and the lower section has a semicircular lower perimeter, a central circular concavity, and two lateral concavities.

4. The manicure device according to claim 3, wherein:

the left minor extension engages the right minor concavity;

the right major extension engages the left major concavity;

the left major extension engages the right major concavity; and the right minor extension engages the left minor concavity; and wherein the central holes of the left minor extension, right major extension, left major extension, and the right minor extension axially align.

5. The manicure device according to claim 4, wherein the watch strap spring bolt extends through the central holes of the left and right major extensions and the left and right minor extensions of the left outer piece and the right outer piece to hingedly engage the left outer piece with the right outer piece and rotate relative to each other about a central hinge axis of the central holes.

6. The manicure device according to claim 5, wherein the first blunt end of the base piece engages a front end of the watch strap spring bolt, and the second blunt end of the base piece engages a rear end of the watch strap spring bolt to secure the watch strap spring bolt within the central holes of the left and right major extensions and the left and right minor extensions of the left outer piece and the right outer piece.

7. The manicure device according to claim 6, wherein a left edge of the base piece slidably engages over the semicircular lower perimeter of the left outer piece, and a right edge of the base piece slidably engages over the semicircular lower perimeter of the right outer piece, the left lower section, the right lower section and the base piece co-operating to enclose the pair of springs.

8. The manicure device according to claim 3, wherein the upper section of the inner face of the left outer piece and the upper section of the inner face of the right outer piece co-operate to define a cavity configured to receive a portion of the finger or thumb of the second hand, and wherein the concave rear edge of the left outer piece and the concave rear edge of the right outer piece co-operate to define a parabola-shaped opening configured to receive the portion of the finger or thumb of the second hand extending therethrough.

9. The manicure device according to claim 1, wherein the straight front edge of the upper section of the left outer piece is configured to engage a left paronychium of the finger or thumb of the second hand, and the straight front edge of the upper section of the right outer piece is configured to engage a right paronychium of the finger or thumb of the second hand and support the nail at an angle of 250 relative to the hinge axis.

10. The manicure device according to claim 1, wherein, in the closed position, the upper section of the inner surface of the left outer piece and the upper section of the inner surface of the right outer piece engage and stabilize the finger or thumb of the second hand.

11. The manicure device according to claim 1, wherein a first end of the first spring is configured to engage the first flattened cylinder and a second end of the first spring is configured to engage a left circular concavity disposed in the lower section of the left outer piece, and a first end of the second spring is configured to engage the second flattened cylinder and a second end of the second spring is configured to engage a right circular concavity disposed in the lower section of the right outer piece.

12. The manicure device according to claim 1, wherein the flat portion of the base piece supports the nail of the finger or thumb of the second hand at a height of 4 cm from the surface.

13. The manicure device according to claim 1, wherein a curvature of the base piece is configured to support the nail of the finger or thumb of the second hand relative to the surface while allowing a user to adjust the angle of the nail relative to the surface.

14. The manicure device according to claim 1, wherein the left upper section and the right upper section co-operate to define a cavity to support the first finger or thumb of the second hand, a central axis of the cavity extending parallel to the hinge axis.

* * * * *